United States Patent [19]

Garcea

[11] 4,137,517

[45] Jan. 30, 1979

[54] POTENTIOMETRIC REGULATOR OF A PHYSICAL MAGNITUDE WHICH IS A FUNCTION WHATEVER OF OTHER TWO MAGNITUDES

[75] Inventor: Giampaolo Garcea, Milan, Italy

[73] Assignee: Alfa Romeo S.p.A., Milan, Italy

[21] Appl. No.: 797,874

[22] Filed: May 17, 1977

[30] Foreign Application Priority Data

May 19, 1976 [IT] Italy ..... 23414 A/76

[51] Int. Cl.[2] ..... H01C 10/30

[52] U.S. Cl. ..... 338/118; 123/140 CC; 338/126; 338/140; 338/185

[58] Field of Search ..... 338/118, 126, 127, 122, 338/140, 162, 167, 170, 190, 185; 123/32 EA, 140 CC; 73/719, 725, 734, 746

[56] References Cited

U.S. PATENT DOCUMENTS

| | | | |
|---|---|---|---|
| 2,081,572 | 5/1937 | Bagno | 338/174 X |
| 3,629,776 | 12/1971 | Watano | 338/140 |
| 3,720,193 | 3/1973 | Monpetit | 123/32 EA |
| 3,750,631 | 8/1973 | Scholl et al. | 123/32 EA |
| 3,844,265 | 10/1974 | Surace et al. | 123/140 CC |

*Primary Examiner*—C. L. Albritton

*Attorney, Agent, or Firm*—Holman & Stern

[57] ABSTRACT

A regulation device is disclosed, for regulating a physical magnitude as a function of two independent parameters: the parameters can be, for example, parameters of interest in the operation of an internal-combustion engine. Instead of the conventional space cam, a surface is provided on which the third dimension is represented by different voltage so as to define on such a planar or curved surface a family of equipotential curves. The readings taken by a conductive follower are mechanically converted so as to govern the appropriate component parts of an engine so as to have an automatical adjustment of certain parameters. The device is dependable and reliable and cannot be prone to jamming or mechanical defects. The device is of the potentiometric class.

3 Claims, 5 Drawing Figures

POTENTIOMETRIC REGULATOR OF A PHYSICAL MAGNITUDE WHICH IS A FUNCTION WHATEVER OF OTHER TWO MAGNITUDES

In the technology, the necessity is often felt of supplying the numerical value of a physical magnitude, Z, starting from the knowledge of the numerical values of other two physical magnitudes, X and Y, of which the aforesaid magnitude Z is a depending function. As an alternative, and likewise, there is the necessity of automatically carrying out the regulation of the physical magnitude, Z, starting from the information of the values of two other physical magnitudes, X and Y, said regulation being intended to adhere to a preselected relationship such as $Z = f(X, Y)$, on the basis of which Z is a preselected function of the two independent variables X and Y.

In the case in which such a relationship can be expressed in mathematical form, the problem can be solved with the aid of an electronic calculation unit to which the values of X and Y are supplied in the numerical (digital) form. The electronic unit will supply, still in numerical form, the values of Z which correspond to any particular couple of values of X and Y. The cost and the intricacy will obviously be the higher, the more intricate the relationship f(X,Y), will be.

Should the relationship f(X,Y) be incapable of being expressed in mathematical terms, the problem can be solved electronically by storing the numerical values of Z which correspond to a sufficiently high number of couples of numerical values of X and Y. A particular calculation circuit could possibly supply by interpolation the values of Z which correspond to the values of X and Y which do not coincide with the stored values.

In an analogic form, the storage of the values of Z as the values of X and Y are varied can be carried out, and is already carried out, by constructing a spatial cam in which, as a function of two different dimensions, x and y, a dimension z normal to x and y, is proportional to he magnitude Z. By so doing, a follower member sticking to cam surface effects displacements z when relative displacements between follower and cam are impressed along the two directions x and y, said displacements being proportional to the magnitudes X and Y. The displacements of the feeler along the direction z can directly be exploited to carry out the desired regulation if the follower has the energy available which is required for the regulation, but they could also be used for energizing a potentiometer. The value of the voltage supplied by the potentiometer, which is an expression of the value of the magnitude Z is then used in an electronic circuit intended for the automatic regulation of the physical magnitude Z as a function of the physical magnitudes X and Y. As regards the potentiometric regulators referred to above, which are based on the use of a spatial cam and a follower, the most prominent difficulties in the mass production technology are those inherent in the manufacture of the spatial cam. This is especially due to the inaccuracies originated by the machining tolerances of the spatial surface, but also in connection with the fact that exceedingly high slopes in a few portions of the spatial surface could be conducive to jamming in the relative displacements of the cam and the follower along the directions x, or y, or also in connection with the exceedingly high loads which are required in order that such displacements may be obtained.

The principal object of the present invention is that of providing a potentiometric regulation device which effects the same operations of the devices referred to above, but without being affected by the constructional and functional defects which now impair such devices.

The device according to the invention also comprises, as it is obvious, two members which can be displaced relative to one another along two different directions and the displacements impressed along these two directions are an expression of the values of the two physical magnitudes X and Y. However, one of them is no longer a spatial cam but a plate the surface of which is evolved along two directions, x and y, and the second member is a follower which is maintained only in contact with such a surface, so that it does not carry out any displacements along the direction normal to x and y: its task is that of detecting the voltage level which exists in the particular point of the plate with which it is in contact and of sending said voltage level to the electronic regulation circuit, the input of which will have a high impedance. As a matter of fact, according to the invention, in each and every point of the plate surface, which is characterized by a couple of values of x and y (these being expressions of a couple of values of the physical magnitudes X and Y); the value of the function $Z = f(X, Y)$ is stored in the form of a voltage level Vz, whereas, as aforementioned, such a value is stored, in a spatial cam, in the form of a dimension z in the direction perpendicular to the directions of x and y. In the same way in which, for the spatial cam, it is possible to identify constant level lines $K_1$,$K_2$ and so on, the points of which satisfy relationships of the kind $f(X, Y) = K_1$, $f(X, Y) = K_2$ and so forth, thus likewise, on the surface of the plate it is possible to identify and to trace particular lines $K_1$,$K_2$ and so forth, along each of which the voltage level is a constant and is equal to $V_1$, $V_2$ and so forth and the constructional characteristic of the plate according to the present invention is based on the consideration of such constant voltage level. To the plate, having a substantially constant thickness and composed by a material which has a poor but constant conductivity, adhere, in correspondence with one of the surfaces and along a certain number of constant level lines relative to the magnitude to be regulated, as many thin members which consist of a material having a high conductivity.

The regulation device according to this invention comprises, in addition, an electric feed circuit which can be arranged as an entity with the plate: said circuit is so arranged that, while two of its ends are maintained at two different and constant values of electric voltage, particular intermediate points therebetween are brought to particular intermediate voltage values such as $V_1$, $V_2$ and so forth; which are also constant.

Each of said particular points of the electric circuit is then connected electrically with each of the thin members aforementioned. In this manner, along each of these thin members, and thus also along each of the aforesaid particular lines of the plate, the voltage level is constant and is equal to $V_1$,$V_2$ and so forth.

On account of the poor electric conductivity of the plate material, when the point of contact of the follower on the plate is in registry with one of the points of the particular lines aforesaid, the follower which is connected to a high-impedance circuit, is brought to the voltage level $V_1$, or $V_2$ or the like, as the point of contact is a point belonging to the plate areas enclosed between two adjoining particular lines such a point is brought to a voltage which is indetermediate between; and capable of being interpolated, between said contiguos particular lines.

Features and advantages of the invention will be better understood with reference to the accompanying drawings which show by way of example and without limitation a few preferred embodiments of the regulating device acoording to the invention.

Figure 1:
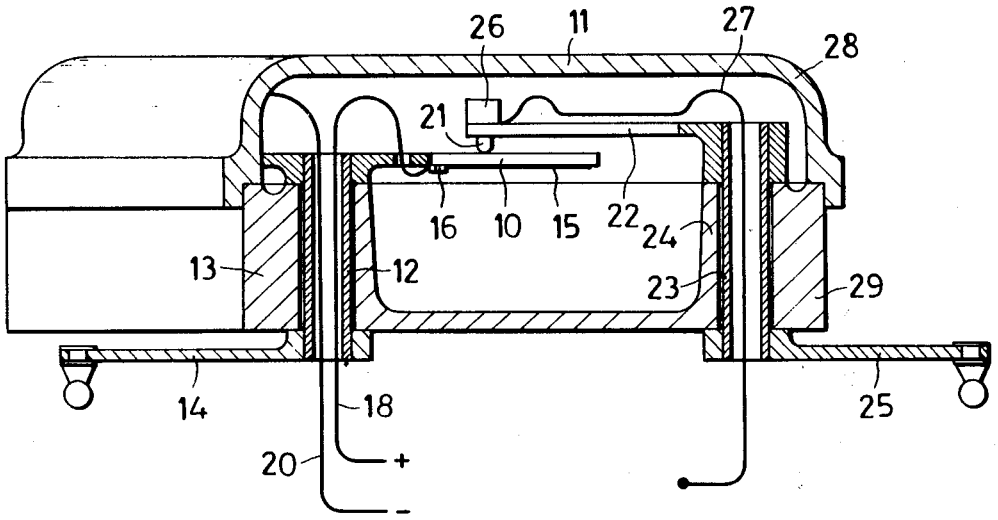
FIG. 1 shows a first version of the regulator in cross-sectional view taken along the line I—I of FIG. 2.
Figure 2:
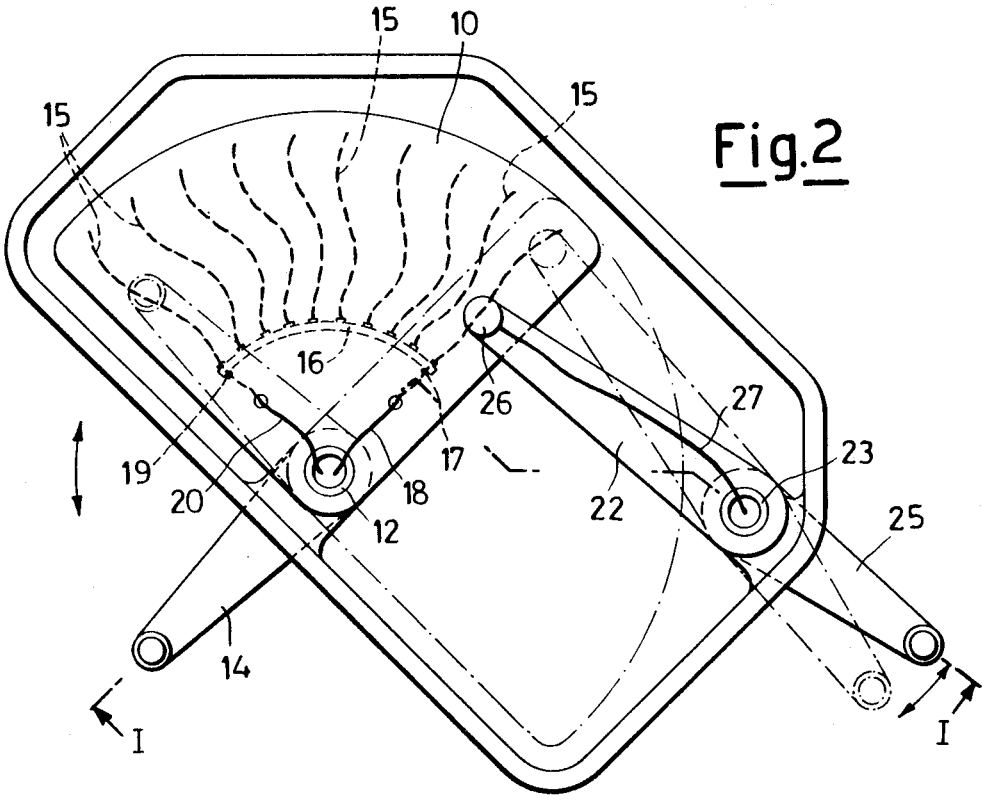
FIG. 2 is a plan view of the regulator of FIG. 1, the lid having been removed.

In the regulator shown in FIGS. 1 and 2, the numeral 10 connotes a planar plate having the outline of a circular sector, the plate being pivoted in a box, generally indicated at 11. The plate 10 is integral with the hollow arbor 12 which is supported for rotation by the bushing 13, the latter being an entity with the box 11. At 14 is shown a lever integral with the pin 12 and arranged outside the box 11. The plate 10 can clearly be seen in FIG. 2, which is a plan view of the regulator, in which the lid 28 of the box 11 is separate from the body 29.

The plate 10 having a thin and constant thickness, is made with material having a poor and constant conductivity and, on either surface of the plate there are affixed a plurality of conductors 15 arranged along curves which have been traced experimentally and along every one of which the physical magnitude to be regulated takes a value which is constant as the regulation parameters are caused to vary.

The conductors 15 are connected in parallel to a bus bar 16 which has the shape of a annular sectorial bar made of a material having an appropriate and even resistivity. The bus bar 16 is connected via the clamp 17 to a conductor indicated at 18 and which; via the hollow arbor 12, emerges from the regulator box to be connected to the positive pole (+) of a stabilized-voltage power source. The bus bar 16 is also connected via the clamp 19 to a lead indicated at 20, which, still via the hollow bar arbor 12, also emerges from the regulator box to be connected to the ground, possibly through an appropriate ballast resistor.

Thus, when the bus bar 16 is live, there are in the attachment points of the leads 15, different voltage levels the values of which are decreased when coming from the clamp 17 towards the clamp 18, and each conductor takes along its entire length the voltage level which is established in its point of attachment to the bus 16. In the plate areas which are comprised between two adjoining conductors, the voltage takes levels which are intermediate between those which correspond to the two adjoining conductors which confine the in-between area.

With a surface of the plate 10 is maintained in engagement a follower 21, which is linked to the lever 22 (pivoted in the box 11); resilient means being inserted therebetween so as to secure the conctact with the plate surface while being concurrently capable of being driven to rotation by the lever 22 itself. The lever 22 is solid with a hollow pin indicated at 23 and which is supported for rotation by the bushing 24, the latter being integral with the box. To the hollow pin 23 also a second level, indicated at 25, is fastened, which is arranged at the outside of the box 11.

The follower 21 is composed by a small pin of a conductive material and is connected via the clamp 26 to the lead 27 which, through the hollow pin 23, emerges from the regulator box to be connected to the circuit of the device (not shown) which uses the signals delivered by the regulator for carrying out the control of a physical magnitude, such as for example one of interest for the operation of an internal-combustion engine.

The lever 14, which is integral with the plate 10, is mechanically linked to a first device (not shown) responsive to a parameter of which said physical magnitude is a function for example an engine parameter (engine rpm, angle of the throttling butterfly, negative intake pressure), and capable of translating into angular shifts of the lever 14 the variations of the preselected parameter.

The lever 25, which is fastened to the follower 21, is mechanically linked to a second device (not even this is shown) which is responsive to a second parameter of which the physical magnitude to be controlled is a function, for example an engine parameter again, and capable also, of translating into angular shifts of the same lever 25 the variations of such second parameter.

In order to understand the way of operation of the regulator depicted in FIGS. 1 and 2, let it be assumed that such a regulator is used for controlling a physical magnitude of interest for the operation of an internal-combustion engine as a function of two engine parameters, for example the rpm and the throttling angle or the intake negative pressure.

As the working conditions of the engine in its field of use are varied, different values are taken by either parameter of both of the engine parameters takes as regulation parameters and, responsively to their variations, either or both of the levers 14 and 25 are driven to rotation about their pivotal points. The lever 14, in its turn, controls the plate 10 so as to rotate same about its axis and to take different angular positions which are intermediate between the two end positions shown in FIG. 2, that is, the one in which both the plate 10 and the lever 14 are shown in solid lines, and that in which the plate and the levers are shown in phantom. The lever 25 controls, through the lever 22, the follower 21 to be rotated about the axis of the pin 23 and to take different angular positions intermediate between the two end positions as shown in FIG. 2: levers 25 and 22 shown in solid lines and in phantom, respectively.

Thus, in every condition of use of the engine, each of which is defined by a couple of values of the engine parameters, the plate 10 and the follower 21 take a different relative position. The follower thus comes into contact with one of the different points of the plate surface and takes up the voltage level which corresponds to the point of the plate with which it comes into touch, that is, the voltage level which corresponds to one of the leads 15 if the point of contact is located in correspondence with either conductor, and a voltage level intermediate between those corresponding to two adjoining conductors if the point of contact is situated in one of the plate areas comprised between two adjoining conductors. Thus, to each couple of values of the engine parameters which are the selected regulation parameters, there corresponds a certain value of the voltage level taken by the follower. The different voltage levels as felt by the follower are nothing but the regulation signals and are fed, through the lead 27, to the circuit of the device which uses them to carry out the control of a physical magnitude which is on interest for the engine operation.

Figure 3:
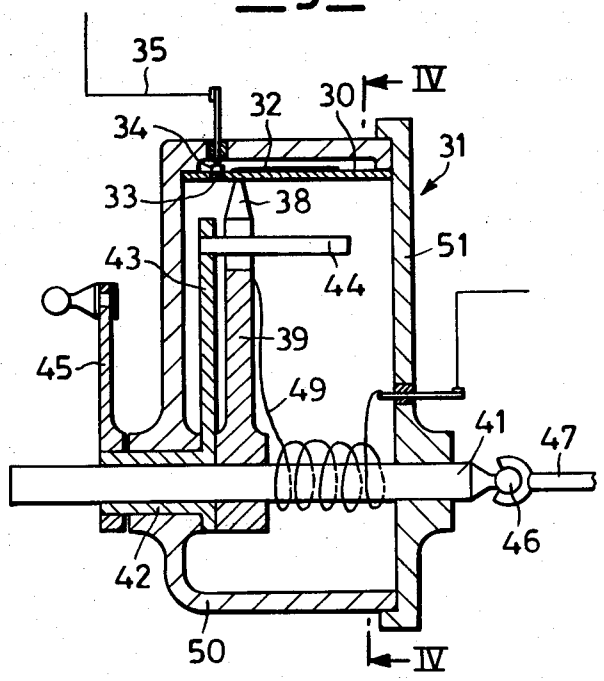
FIG. 3 shows a second version of the regulator in cross-sectional view taken along the line III—III of FIG. 4.
Figure 5:
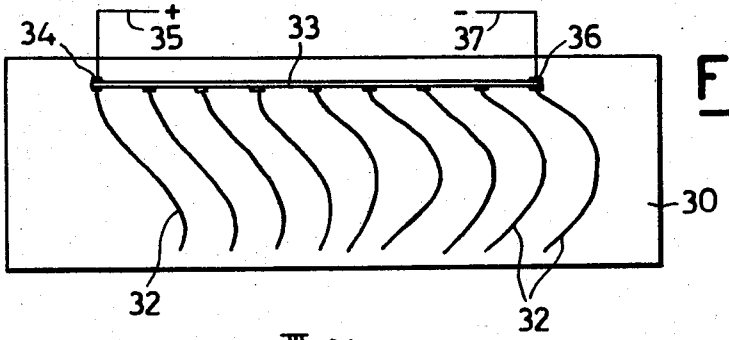
FIG. 5 is a plan view of a detail of the regulator shown in FIGS. 3 and 4.
Figure 4:
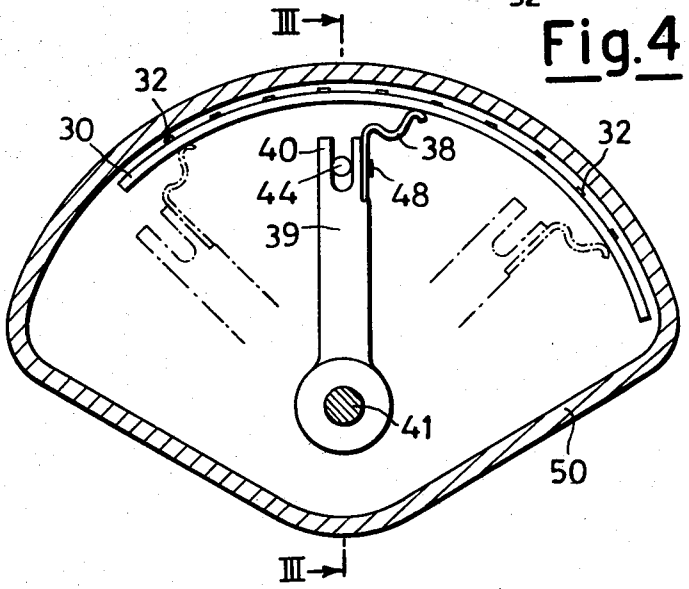
FIG. 4 is a cross-sectional view taken along the line IV—IV of FIG. 3.

The regulator shown in FIGS. 3, 4 and 5 is conceptually similar to that shown in FIGS. 1 and 2 and the difference is only due to a few constructional details. In this case, the regulator is formed by a plate, indicated at 30 and shaped as a hollow cylindrical sector, which is fastened to the box generally indicated at 31 and formed, in its turn, by a body 50 and a lid 51. Like the plate 10 of FIGS. 1 and 2, the plate 30 is formed by a material having an even resistivity and on either face thereof are affixed a plurality of conductors 32, connected in parallel to a bus bar 33 which, in its turn, via a clamp 34 and a lead 35, is connected to a stabilized voltage (+) positive power source and is also grounded through the clamp 36 and a lead 37 (as shown in FIG. 5 which is a plan view of the plate 30).

With the concave surface of the plate 30 there is maintained in engagement a follower 38 which is formed by a blade of a conductive material and is shaped substantially in the form of an "L" with a side appropriately bent so as to provide a contact which resembles, in the closest possible way, to a point contact and in such a way as to provide a resilient bias of the blade against the plate, as can be seen in FIG. 4. The follower 38 is fastened to a level 39 having at either end a slot 40 and is connected, through the clamp 48, to a lead 49 which emerges out of the box 31 to be connected to the circuit (not shown) which utilizes the signals delivered by the regulator for effecting the control of a physical magnitude, such as one of interest for the operation of an internal-combustion engine. The lever 39 is fastened to an arbor indicated at 41, which is supported by the box 31 in such a way that such arbor can undergo both axial shifts and axial rotations. On one side, the arbor 41 is supported in the body 50 of the box 31 with the intermediary of a bushing, indicated at 41 and which, in its turn, is supported for rotation in the same body 50. The bushing 42 carries integrally therewith a lever 43 which is arranged radially and carries at either end a finger 44: the latter enters a slot 40 of the lever 39. To the same bushing 42 is also fastened, externally of the box 31, a second lever, indicated at 45, which must be mechanically linked to a first device (not shown), the latter being capable of converting into angular shifts of the lever 45 as such the variations of a first preselected parameter, for example an engine parameter.

The arbor 41, which is also supported by the lid 51 of the box 31, is connected through the spherical joint 46 to a rod indicated at 47 and which is mechanically linked to a second device (not shown) capable of converting in axial shifts of said rod 47 the variations of a second preselected parameter, such as an engine parameter.

Thus, as the first preselected parameter is varied, the lever 45 controls via the finger 44, the lever 39 to have it rotating about the axis of the arbor 41 and the follower 38 to be displaced circumferentially along the surface of the plate 30. As the second preselected engine parameter is varied the rod 47 drives, through the arbor 41, the lever 39 to be displaced axially and the follower to be moved longitudinally along the plate surface. The follower thus comes into contact with one of the several points of the plate surface and takes the voltage level with appertains to said point, namely, either the level of one of the conductors 32 if the contacted point is located in correspondence with one of such conductors, or a voltage level which is intermediate between those of two adjoining conductors if the contacted point is located in a zone of the plate comprised between two adjoining conductors. Also in this case the different levels of voltage which correspond to the several couples of values of the two preselected parameters make up the regulation signals and reach the circuit of the device which exploits them to effect the control of the physical magnitude concerned.

What I claim is:

1. A potentiometric regulator for providing a desired voltage output based upon two independent internal combustion engine parameters, said regulator comprising:

a poor and constant conductive surface having first and second directions;

a plurality of conductors extending along said surface generally in said first direction;

voltage means for supplying a preselected voltage to each of said conductors;

pin means for establishing electrical contact with a portion of said plurality of conductors on said surface directly or through said surface;

first means, responsive to one of said engine parameters, for providing relative movement between said surface and said pin means in said first direction;

second means, responsive to the other of said engine parameters, for providing relative movement between said surface and said pin means in said second direction; and each of said plurality of conductors arranged along traced curves on said surface so as to provide said desired voltage output based upon said combination of engine parameters.

2. The regulator in accordance with claim 1 wherein said surface is generally planar and movable about a first pivot, said first direction extending radially outwards from said pivot and said second direction extending circumferentially around said pivot, said first means comprising pivotally mounting said pin means such that movement of said pin means about said pivotal mount provides movement of said pin means generally in said first direction, said second means comprising said pivotal mounting of said surface such that movement of said surface about said pivotal mount results in relative circumferential movement between said pin means and said surface.

3. A regulator in accordance with claim 1, wherein said surface comprises a cylindrical surface having an axis of revolution and a circumferential direction, said axis of revolution comprising said first direction and said circumferential direction comprising said second direction, said first means comprises means mounting said pin means for movement in said longitudinal direction, and said second means comprises means mounting said surface for rotation about said axis and moving said surface relative to said pin means in said second direction.

* * * * *